US006392209B1

(12) United States Patent
Oppitz

(10) Patent No.: US 6,392,209 B1
(45) Date of Patent: May 21, 2002

(54) ELECTRIC HEATING ELEMENT

(75) Inventor: Hans Oppitz, Milserheidestrasse (AT)

(73) Assignees: Manfred Elasser, Patsch (AT); Latec AG, Zollikon (CH)

( * ) Notice: Subject to any disclaimer, the term of this patent is extended or adjusted under 35 U.S.C. 154(b) by 0 days.

(21) Appl. No.: 09/629,162

(22) Filed: Jul. 31, 2000

Related U.S. Application Data

(63) Continuation-in-part of application No. PCT/EP99/00069, filed on Feb. 2, 1999.

(30) Foreign Application Priority Data

| | | |
|---|---|---|
| Feb. 2, 1998 | (AT) | 162/98 |
| May 26, 1998 | (DE) | 198 23 494 |
| May 26, 1998 | (DE) | 198 23 531 |
| May 26, 1998 | (DE) | 198 23 498 |
| May 26, 1998 | (DE) | 198 23 493 |

(51) Int. Cl.[7] ..... H05B 3/34

(52) U.S. Cl. ..... 219/549; 219/543; 219/552; 219/541; 399/333

(58) Field of Search ..... 219/216, 541, 219/553, 552, 549, 543; 399/333

(56) References Cited

U.S. PATENT DOCUMENTS

| | | | | |
|---|---|---|---|---|
| 3,364,337 A | | 1/1968 | Kahn | |
| 3,598,961 A | | 8/1971 | Hager, Jr. et al. | |
| 3,697,728 A | | 10/1972 | Stirzenbecher | |
| 3,763,350 A | * | 10/1973 | Hager, Jr. | 219/549 |
| 3,808,403 A | * | 4/1974 | Kanaya et al. | 219/528 |
| 3,934,119 A | | 1/1976 | Trenkler | |
| 4,518,851 A | | 5/1985 | Oppitz | |
| 4,616,125 A | | 10/1986 | Oppitz | |
| 4,645,913 A | | 2/1987 | Oppitz | |
| 4,801,784 A | | 1/1989 | Jensen et al. | |
| 5,215,820 A | * | 6/1993 | Hosowaka et al. | 428/403 |
| 5,346,720 A | | 9/1994 | Lombard et al. | |
| 5,824,996 A | * | 10/1998 | Kochman et al. | 219/529 |

FOREIGN PATENT DOCUMENTS

| | | |
|---|---|---|
| AT | 274965 | 10/1969 |
| AT | 313588 | 8/1970 |
| DE | 1 565 888 | 4/1970 |
| DE | 26 34 932 | 2/1977 |
| DE | 3021737 | 12/1980 |
| DE | 35 02 838 | 8/1985 |
| DE | 87 12 831 | 1/1988 |
| DE | 9001187 | 5/1990 |
| EP | 0 237 228 | 9/1987 |
| FR | 1 347 047 | 10/1962 |
| FR | 2 069 719 | 9/1971 |
| FR | 2 348 614 | 11/1977 |
| GB | 1 283 444 | 7/1972 |
| JP | 7 271228 | 10/1995 |
| JP | 8-156165 | 6/1996 |
| JP | 8 262910 | 10/1996 |
| WO | 89/02155 | 3/1989 |
| WO | 90/03713 | 5/1990 |

* cited by examiner

*Primary Examiner*—Teresa Walberg
*Assistant Examiner*—Shawntina Fuqua
(74) *Attorney, Agent, or Firm*—Oliff & Berridge, PLC

(57) ABSTRACT

A flat heating element includes a thin resistance layer which contains an electro-conductive polymer and at least two flat electrodes arranged on One side of the resistance layer at a distance from each other, wherein the polymer has an intrinsic electric conductivity caused by a content of at least one metal or semimetal atom dopant.

24 Claims, 6 Drawing Sheets

ELECTRIC HEATING ELEMENT

Figure 1:
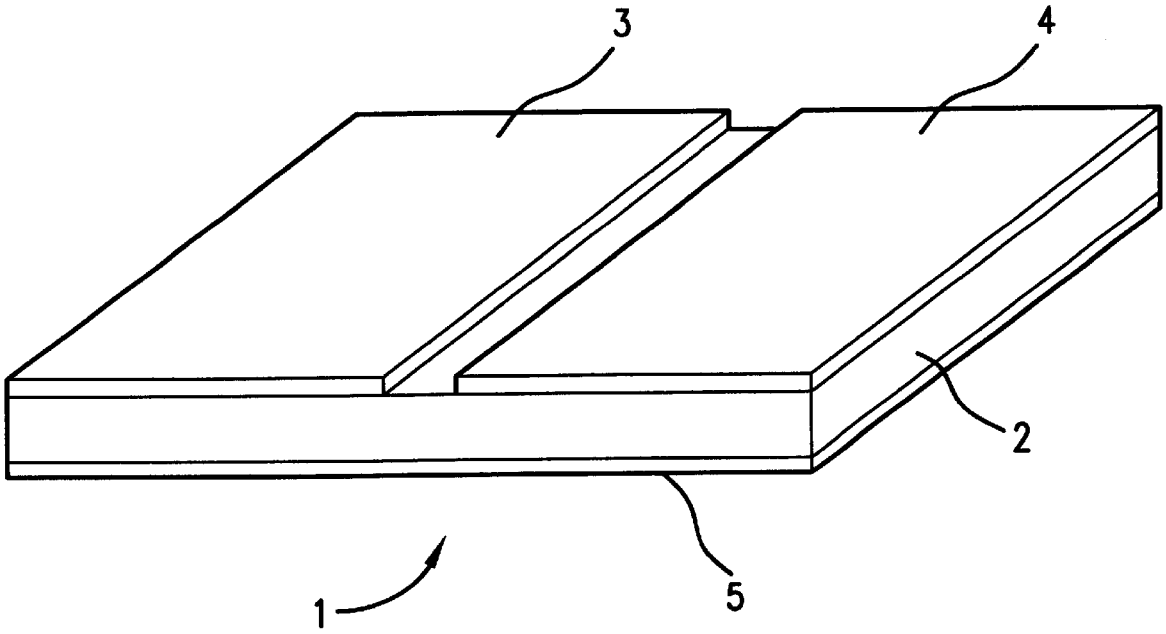

This application is a continuation-in-part of PCT/EP99/00069 filed Feb. 2, 1999.

Electric heating elements are used in different sectors to generate heat; they require high voltages in order to generate a sufficiently high temperature. These high voltages, however, can constitute safety risks, particularly when used to heat media or when in contact with the human body. Moreover, because of the materials used in them, most traditional heating elements are suitable only for low temperatures, particularly in long-term operation. Other proposals of the prior art require a complex constitution of the heating element und hence limit possible applications of the heating element.

It is one object of the present invention to provide a heating element with which a high output per unit area and thus high temperatures can be generated even in long-term operation while low voltages prevail in the heating element. In addition, the heating element should be versatile in its applications and simple to provide with contact terminals. This is especially important for hollow structures to be heated such as pipes, transportation devices, e.g. heatable tanks or other containers, or heat roller shells.

Pipes are extensively employed, for instance, to conduct fluid media. When such pipes for instance are laid underground or as open-air piping in cold regions, the risk exists that the medium present in the pipe solidifies because of the low temperatures, and the pipe clogs.

Media such as gases or liquids often are transported in heatable tanks mounted on railway cars or on trucks. At low ambient temperatures, the medium in the tank can freeze and thus may even damage the tank. The installation of heating elements in such cars is highly demanding with respect to the heating element as well as to the heat transfer that can occur between the heating element and the car. Dangerous substances sometimes are transported in such tanks. It is important then that the heating element will not lead to any local temperature increase. But also a failure of the heating element, for instance as a result of its detachment from the tank, must be avoided in order to prevent freezing of the medium.

It is therefore a further object of the present invention to provide a heating element for a transportation device in which during transport a medium can be kept at a predetermined temperature, without creating safety risks such as freezing, an explosion or a fire.

Heat rollers which can be heated to a certain temperature, particularly for use in copying or foil-coating machines, are required in many areas of heating technology. Up to now such heat rollers have been produced with heating elements having resistance wires embedded in an insulating mass. Another operating mode of heat rollers, for instance in copiers, is the installation of a halogen emitter in the roller. Both of these versions have the disadvantage of being either very expensive in their manufacture or exhibiting a poor efficiency of heat transfer.

It is therefore a still further object of this invention to provide a heating element for a heat roller of simple design that can be operated with low voltage and at the same time has a high heat transfer efficiency. The heat roller should further be versatile in its applications.

The invention is based on the realization that all these objects can be reached by a heating element in which the heating current flows in an optimum way through a suitable resistive mass, the heating element being of flat shape and guaranteeing a heat transfer that is uniform across the area to be heated.

According to the invention, the objects are reached by a flat heating element comprising a thin resistance layer which contains an electro-conductive polymer and at least two flat electrodes arranged on one side of the resistance layer at a distance from each other, wherein the polymer has an intrinsic electric conductivity caused by a content of at least one metal or semimetal atom dopant.

These polymers which, according to the invention, are used in the resistance layer have a constitution such that the current flows along the polymer molecules. Owing to the polymer structure, the, heating current is conducted through the resistance layer along the polymers. Because of the electric resistance of the polymers, heat is generated which can be transferred to an object to be heated. Here the heating current cannot follow the shortest pathway between the two electrodes but follows the structure of the polymer arrangement. Thus, the length of the current path is predetermined by the polymers, so that even in the instance of small layer thicknesses, relatively high voltages can be applied without causing a voltage breakdown. Even in the instance of high currents such as making currents, one must not be afraid of a burn-out. Moreover, the distribution of the current in the first electrode and its subsequent conduction along the polymer structure in the resistance layer leads to a homogeneous temperature distribution within the resistance layer. This distribution arises immediately after applying voltage to the electrodes.

Because of the polymers employed according to the invention, the heating element, the pipe, the transportation device and the roller shell to be heated can be operated even at high voltages, for instance line voltage. As the attainable heating power increases with the square of operating voltage, the resistance-heating element, the pipe, the transportation device and the roller according to the invention can yield high heating power and hence high temperatures. According to the invention, the current density is minimized because a relatively long current path is provided along the electro-conductive polymers or because at least two zones are created which are electrically in series and contain the intrinsically electro-conductive polymer used according to the invention.

Moreover, the electro-conductive polymers used according to the invention exhibit long-term stability. This stability is explained above all by the fact that the polymers are ductile, so that a rupture of the polymer chains and thus interruption of the current path will not occur when the temperature is raised. The polymer chains are unharmed even after repeated temperature fluctuation. In conventional heating elements, to the contrary, where conductivity is created, for instance, by carbon black skeletons, such a thermal expansion would lead to interruption of the current path and hence to overheating. This would lead to a strong oxidation and to bum-out of the resistance layer.

Similar considerations apply to konwn intrinsically electro-conductive polymers containing chemical compounds and/or ions which sharply reduce the long-term stability of the resistance layer subject to electric currents. It was revealed that polymers which contain a higher percentage of ions have a low aging resistance when subject to electric currents, since electrolysis reactions lead to spontaneous destruction of the resistance layer.

The intrinsically electro-conductive polymer used according to the invention is not subject to such aging phenomena; they resist aging even in reactive environments such as air, let alone oxygen. Moreover, current conduction through the resistive mass is of the electronic conduction type. Hence even an autodestruction of the resistance layer by electrolysis reactions caused by electric currents will not occur in the heating element according to the invention in which time-dependent drops in heating power per unit area are very small and approximately zero, even at temperatures as high as e.g. 500° C. and at heating powers per unit area as high as e.g. 50 $kW/m^2$.

Due to the use of intrinsically electro-conductive polymers, the resistance layer as a whole which is used according to the invention presents a homogeneous structure that permits a heating that is uniform across the entire layer.

According to the invention, contact to the heating element is provided by two electrodes which preferably consist of a material of high electric conductivity and are arranged on one side of the resistance layer. This type of contact arrangement makes it possible to use the mode of operation of the inventive heating element in a particularly advantageous way. The current applied first spreads within the first electrode, then crosses the thickness of the resistance layer along the polymer structure, and finally is conducted to the second contacted electrode. Therefore, the current path is additionally extended over that present in a structure where the resistance layer is sandwiched between the two electrodes. Due to this flow of the current the thickness of the resistance layer can be kept small.

The heating element with which the hollow structure, i.e. the pipe, the transportation device and/or the roller shell are to be heated according to the invention, has the further advantage of being versatile in its applications. The electrodes are provided with contacts on one side of the resistance layer. The opposite side of the resistance layer therefore is free of contact terminals, and hence can be of flat shape. Such a flat surface permits a direct application of the heating element to the structure to be heated. An ideal heat transfer becomes possible since the contact area between the heating element and the structure to be heated is not disrupted by contact terminals if the surface of said structure consists of a material having a high electric conductivity.

If this is not the case, in another preferred embodiment of the invention, a flat floating electrode is arranged on the side of the resistance layer opposite to the two flat electrodes. In the spirit of the invention, an electrode is called floating when it is not connected to the source of current. It can have an insulation preventing electric contact with a source of current.

This floating electrode supports the flow of current through the resistance layer. In this embodiment the current spreads within the first electrode, crosses the thickness of the resistance layer to reach the floating electrode on the opposite side, is conducted further within this electrode, and finally flows through the thickness of the resistance layer to the other electrode that is arranged on the same side of the resistance layer as the first electrode.

In this embodiment of the heating element the current flows through the thickness of the resistance layer, essentially in a direction normal to its surface. Essentially two zones develop within the resistance layer. Within the first zone, the current flows essentially vertically from the first contacted electrode to the floating electrode, while within the second zone, it flows essentially vertically from the floating electrode to the second contacted electrode. Thus, a series arrangement of several resistances is attained by this arrangement. This effect implies that the partial voltage prevailing in the individual zones is smaller than the applied voltage. Thus, in this embodiment of the invention the voltage prevailing in the individual zones is half of the applied voltage. Because of the low voltage prevailing in the resistance layer, safety risks can be avoided with the heating element according to the invention, and possible applications thus are manifold and not limited to the beforementioned hollow structures.

The heating element can then also be used in devices where it comes in immediate contact with a medium to be heated, or must be touched by the persons which operate or use the device. A pipe fitted with the heating element according to the invention can be employed in wet areas or moist ground or find applications where people must touch the pipe. The transportation device according to the invention can thus also be used in applications in which people must touch the container. In the transport of media, the device according to the invention is exposed to atmospheric conditions. Thus, the device can come in contact with water, particularly in rain or snow. However, a safety risk will not arise by this contact because of the extremely low voltage prevailing in the resistance layer of the heating element according to the invention which may be operated with a conventional power source such as a battery. This can readily be mounted on the railroad car or truck. In the latter instance the device according to the invention can even be powered by the truck's battery, which represents an additional design simplification.

Moreover, the gap provided between the contacted electrodes acts as an additional resistance arranged in parallel. With air as the insulator in this gap, the resistance will be determined by the mutual distance of the electrodes and thus by the surface resistance of the resistance layer. The distance is preferably larger than the thickness of the resistance layer, for instance twice the thickness of the resistance layer.

The electrodes and the floating electrode preferably have a good thermal conductivity. This can exceed 200 W/m·K, preferably 250 W/m·K. Local overheating can rapidly be neutralized by this good thermal conductivity in the electrodes. An overheating is thus possible only in the direction of layer thickness, but has no negative effects because of the small layer thickness that can be realized in the heating element according to the invention of which it is a further advantage that even a local temperature increase provoked from outside, e.g. from the body to be heated, can be balanced in an ideal way. Such an increase in temperature can occur for instance in pipes or with containers only partly filled, since in zones that are filled with air, less heat is transferred from the pipe or the container to the air. Such a temperature rise can also be produced from the inside, for instance when an accumulation of heat occurs in the heat roller. For this reason a thermal insulating material can be provided inside the roller.

The electrodes and the floating electrode are preferably made of a material having a high electric conductivity. Thus, the specific electric resistance of the electrodes may be less than $10^{-4}$ Ω·cm, and preferably less than $10^{-5}$ Ω·cm. Suitable materials are e.g. aluminium and copper. By selecting such an electrode material it is guaranteed that the current applied is conducted further within the flat electrode, i.e., spreads within it, before passing through the resistance layer. This leads to a uniform flow of the heating current through the resistance layer and thus a uniform and essentially complete heating of the resistance layer. Such a heating element therefore is able to generate and transfer heat in a uniform way. By selecting such an electrode material it is possible in particular to fabricate large heating elements without a need for voltage supply to a number of spots along the length or width of the electrodes. Therefore, power supply lines need not be installed along the surface. According to the invention, such multiple contacts will only be selected for embodiments in which the heating element covers a large area or length, for instance areas larger than 60 $cm^2$, preferably larger than 80 $cm^2$. The limiting size of the heating element above which it becomes meaningful to provide multiple contact points depends not only on the electrode material selected, but also on the place of the contacts. Thus, multiple contact points may not be required even for areas larger than those mentioned above when the electrode is accessible in its surface midpoint and can be provided with a contact there.

The size of the heating element, the length of the pipe and the transportation device as well as the heat-up rate and the temperature generated across the roller surface further depend on the thickness of the selected electrodes that can be operated, with single contacts According to one embodiment, the electrodes and—if present—the floating electrodes have a thickness of 50 to 150 $\mu$m, preferably 75 to 100 $\mu$m each. These small layer thicknesses are also advantageous in that the heat produced by the heating element can readily be transferred from them, e.g. from the interlayer to the body to be heated. Moreover, thin electrodes are more flexible, so that a detachment of the electrodes from the resistance layer and thus an interruption of the electrical contact during thermal expansion of the resistance layer will be avoided.

According to the invention, the resistance layer is thin. Its thickness has a lower limit that merely depends on the breakdown voltage, and is preferably 0.1 to 2 mm, preferably about 1 mm. A small layer thickness of the resistance layer offers the advantage of enabling a short heat-up time, rapid heat transfer and high heating power per unit area. However, such a layer thickness is only possible with a heating element according to the invention. On one hand, the current path within the resistance layer is predetermined by the polymers used according to the invention, and can be sufficiently long to prevent voltage breakdown, even when the layer thicknesses are small. On the other hand, the unilateral contact arrangement of the heating element permits subdivision of the resistance layer into zones of lower voltage, which additionally reduces the risk of breakdown.

The advantages of the heating element and the use of heating elements according to the invention are further enhanced when the resistance layer has a positive temperature coefficient (PTC) of its electric resistance. This leads to an effect of automatic regulation with respect to the highest attainable temperature. This effect occurs, since the flow of current through the resistive mass is adjusted as a function of temperature because of the PTC of the resistance layer. The current becomes lower the higher the temperature, until at a particular thermal equilibrium it has become immeasurably small. A local overheating and melting of the resistive mass can therefore be reliably prevented. This effect is of particular importance in the present invention, related to following reasons:

For the heating element according to the invention, a local temperature rise may occur, for instance, when the heating element according to the invention has insufficient contact with a body to be heated, and hence a low heat transfer. If for instance a heatable pipe or container is only partially filled with a liquid medium, heat is more readily withdrawn from the filled region of the pipe or container than from its region in contact with air. A conventional heating element would heat up and perhaps melt because of deficient heat withdrawal. Such a melting is avoided by the effect of automatic regulation in the heating element according to this invention.

Selecting a PTC material for the resistance layer also implies, therefore, that as a result, the entire resistance layer is heated to essentially the same temperature. This enables uniform heat transfer, which can be essential for particular applications of the heating element and use of heating elements, for instance when heat-sensitive media are conveyed through the pipe or transported in the container. For particular applications of the heat roller, non-uniform heat transfer in some spots for instance may cause the foil to be applied by the roller will not adhere to the substrate, since it was not sufficiently and/or uniformly heated.

According to the invention, the resistance layer can be metallized on its surfaces facing the electrodes and/or the floating electrode (if present). By metallization, metal adheres to the surface of the resistance layer and thus improves the flow of current between the electrodes or the floating electrode and the resistance layer. Moreover, in this embodiment, the heat transfer from the resistance layer to the floating electrode and hence to the body or object to be heated (e.g. pipe, container or roller shell) is also improved. The surface can be metallized by spraying of metal.

The intrinsically electro-conductive polymer is preferably produced by doping of a polymer. The doping can be a metal or semimetal doping. In these polymers the defect carrier is chemically bound to the polymer chain and generates a defect. The doping atoms and the matrix molecule form a so-called charge-transfer complex. During doping, electrons from filled bands of the polymer are transferred to the dopant. On account of the electronic holes thus generated, the polymer takes on semiconductor-like electrical properties. In this embodiment, a metal or semimetal atom is incorporated into or attached to the polymer structure by chemical reaction in such a way that free charges are generated which enable the flow of current along the polymer structure. The free charges are present in the form of free electrons or holes. In this way an electronic conductor arises.

Preferably, for its doping, the polymer was mixed with such an amount of dopant that the ratio of atoms of the dopant to the number of polymer molecules is at least 1:1, preferably between 2:1 and 10:1. With this ratio it is achieved that essentially all polymer molecules are doped with at least one atom of the dopant. The conductance of the polymers and hence that of the resistance layer as well as the temperature coefficient of resistance of the resistance layer can be adjusted by selecting the ratio.

The intrinsically electro-conductive polymer used according to the invention can be employed as material for the resistance layer in the heating element according to the invention, even without graphite addition, but according to a further embodiment, the resistance layer may additionally contain graphite particles. These particles can contribute to the conductivity of the complete resistance layer, are preferably not in mutual contact, and in particular do not form a reticular or skeletal structure. The graphite particles are not solidly bound into the polymer structure but are freely mobile. When a graphite particle is in contact with two polymer molecules, the current can jump via the graphite from one chain to the next. The conductivity of the resistance layer can be further raised in this way. On account of their free mobility in the resistance layer, the graphite particles can also move to the surface of this layer and bring about an improvement of its contact with the electrodes or with the floating electrode or interlayer, or with the body to be heated.

The graphite particles are preferably present in an amount of at most 20 vol. %, and particularly in an amount of at most 5 vol. % relative to the total volume of the resistance layer, and have a mean diameter of at most 0.1

μm. With this small amount of graphite and the small diameter, formation of a graphite network which would lead to current conduction through these networks can be avoided. It is thus guaranteed that the current essentially continues to flow by electronic conduction via the polymer molecules, and thus the advantages mentioned above can be attained. In particular, conduction need not be along a graphite network or skeleton where the graphite particles must be in mutual contact, and which is readily destroyed under mechanical and thermal stress, but it rather occurs along the ductile and aging-resistant polymer.

Both electro-conductive polymerizates such as polystyrene, polyvinyl resins, polyacrylic acid derivatives and mixed polymerizates of these, polyamides and their derivatives, polyfluorinated hydrocarbons, polymethyl metacrylates, epoxides, polyurethanes as well as polystyrene or their mixtures can preferably be used to make up the intrinsically electro-conductive polymers. Polyamides additionally exhibit good adhesive properties, which are advantageous for the preparation of the heating element and the use of heating elements according to the invention, since this facilitates applications to the body to be heated. Some polymers, for instance polyacetylenes, are eliminated from uses according to the invention because of their low aging resistance due to reactivity with oxygen.

The length of the polymer molecules used varies within wide ranges, depending on the type and structure of the polymer, but is preferably at least 500 and particularly preferably at least 4000 Å.

In one embodiment, the resistance layer has a support material. This support material on one hand can serve as carrier material for the intrinsically conductive polymer, on the other hand it functions as a spacer, particularly between the electrodes and the floating electrode or interlayer, or the electro-conductive body to be heated. The support material in addition confers some rigidity to the heating element, so that it will be able to resist mechanical stress. Moreover, when using a support material one can precisely adjust the layer thickness of the resistance layer. Glass spheres, glass fibers, rock wool, ceramics such as barium titanate or plastics can serve as support materials. A support material present as a tissue or mat, for instance of glass fibers, can be immersed into, i.e. impregnated by a mass consisting of the intrinsically electro-conductive polymer. The layer thickness then is determined by the thickness of the grid or mat. Methods such as scraping, spreading or known screen-printing methods can also be used to produce said support material.

Preferably, the support material is a flat porous, electrically insulating material. With such a material it can in addition be prevented that the heating current flows through the support material rather than through the polymer structure.

The possibility of producing layers which across their surface deviate from the desired layer thickness with minimum tolerances, for instance 1%, is of particular significance, especially with the small layer thicknesses used according to the invention, since otherwise there is the danger of a direct contact between contacted electrode and floating electrode. Fluctuations in layer thickness across the layer surface can also influence the temperature generated, and lead to a non-uniform temperature distribution.

The support material has the further effect that the current cannot flow along the shortest path between the electrodes and the floating electrode but is deflected or split up at the filler material. Thus, an optimum utilization of the energy supplied is achieved.

Figure 2:
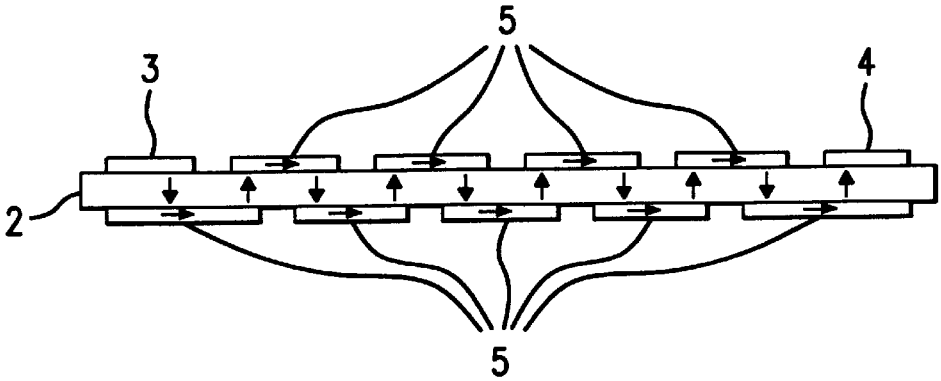
Figure 3:
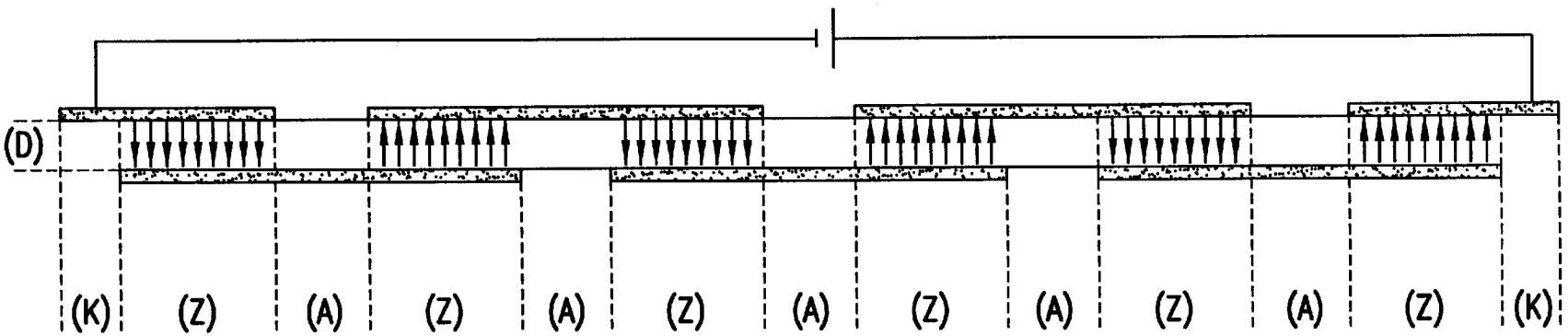

The invention is—by way of example—explained in the following by means of the accompanying drawings which show in FIG. 1 a partial sectional view of one embodiment of the heating element according to the invention;

in FIG. 2 a schematic lateral view of an embodiment with several floating electrodes;

in FIG. 3 a diagrammatic sketch of the zones developing in an embodiment according to FIG. 2.

The heating element 1 has a thin resistance layer 2 and two flat electrodes 3 and 4 arranged side by side at a distance from each other and covering essentially all of the resistance layer. On the opposite side of the resistance layer 2 a floating electrode 5 is arranged which covers the resistance layer over the fall area formed by the electrodes 3 and 4 as well as by the gap between these electrodes. When the electrodes 3 and 4 are brought in contact with a source of current (not shown), the current will first spread within electrode 3; it then flows through the resistance layer 2, essentially in a direction normal to its surface facing the floating electrode 5, is conducted further within this electrode, flows through the resistance layer 2 to the electrode 4 and is drained from there. Depending on the contact arrangement at electrodes 3 and 4, the current may also flow in the opposite direction. In the embodiment represented, the insulation between electrodes 3 and 4 is formed by an air gap.

In FIG. 2, a heating element is shown which has a thin resistance layer 2. On one side of the resistance layer 2, two flat electrodes 3 and 4 as well as several intermediate floating electrodes 5 are provided. Electrodes 3 and 4 and the floating electrodes 5 are at distances from each other and offset relative to the floating electrodes 5 arranged on the opposite side of the resistance layer 2. In this arrangement, the current applied to electrodes 3 and 4 flows through the resistance layer 2 and floating electrodes 5 in the direction indicated by arrows in the drawing. With this current flow, the resistance layer 2 serves as a series arrangement of a number of electric resistances, which makes it possible to attain high power while in the individual sectors or zones of the resistance layer a low voltage prevails. Here, both the resistance residing in the thickness of the resistance layer 2 and the surface resistance in the gaps between the floating electrodes 5 or floating electrode 5 and the electrode 3 or 4 is utilized. The large distance in space between the contacted electrodes moreover offers the advantage that an immediate contact between them can be avoided.

FIG. 3 shows a diagrammatic sketch which will be used to explain the electrotechnical parameters of an embodiment of the heating element according to the invention. Starting from the heating power per unit area of the full heating element which is desired in a particular case, one first determines the number of heating zones required across the width of the heating element from the ratio between the overall voltage to be applied to the contacted electrodes and the unique, maximum partial voltage applied to the individual partial zones which always are arranged in series. The length of the heating zone is designated as S, the width Z of the individual zones itself being calculated by means of the following formula:

$$Z=[B-n\cdot A/2-2\cdot K]/n$$

where

B=total width of the flat heating element (mm)

A=distance between the floating electrodes or floating electrode and the electrode on one side of the resistance layer (mm)

K=width of the lateral band (mm)

n=number of individual heating zones arranged in series

The width of the individual electrodes or floating electrodes which are arranged in alternation on either surface of the resistance layer can be found from the sum of two zone widths and the distance A between the electrodes arranged on one side of the resistance layer.

The heating power $N_z$ of an individual zone of the heating element can be found from:

$$N_z=U_Z\cdot I_G=U_z^2\cdot L=U_z^2\cdot S\cdot Z/\rho\cdot D$$

where

U=the maximum permitted electric zone voltage applied to the partial resistance because of the electrical insulation (breakdown resistance) of the resistance-heating layer required in an individual application (V)

I=current, which because of the series arrangement is constant in all partial resistances, and equal to the total current (A)

L=electric conductance of the intrinsically conductive polymer resistance layer (S)

ρ=specific resistance of the polymer layer (Ω·cm)

S=length of the electrode of the heating element (mm)

Z=width of the individual heating zones (mm)

D=thickness of the resistance layer (mm)

Both the electrodes and the floating electrode in the heating element according to the invention can for instance consist of metal foil or metal sheet. Moreover, the electro-conductive layer can be coated with black plastic on the side facing away from the resistance layer. With this additional layer, the heating element according to the invention can assume the function of a black body and generate a penetration effect of the radiation generated.

In the heating element according to the invention, a multitude of electrodes can be provided on one side of the resistance layer. Heating-up of the heating element zone by zone can be achieved by providing a number of electrodes separated from each other by insulation, arranged next to each other and functioning as electrode pairs to which a voltage can be applied.

It is also within the scope of the invention to realize the insulation between the electrodes with an insulating material introduced into the gap between the electrodes. Conventional dielectrics and particularly so plastics can be used as the insulating material.

In case no voltage should be present at the surface of the heating element that is facing the body to be heated, the resistance layer or the floating electrode can be laminated with polyester, PTFE, polyimide and other foils. The use of these conventional insulating materials and of a simple form such as a foil becomes possible in the heating element according to the invention because the floating electrode is free of contact terminals and hence has a smooth surface.

The resistance layer can have a structure in which different resistive materials with different specific electric resistances are present in the form of layers. This embodiment has the advantage that by suitable selection of the materials in the layers, the side of the resistance layer from which heat is to be transferred to the body to be heated can have higher temperatures, while it is not necessary that different heating currents are separately conducted, for instance with heating wires, in individual layers of the resistance layer. This is achieved when the specific electric resistance of the polymer employed is selected so as to increase from the layer that is adjacent to the electrodes, in a direction to the side facing the body or object to be heated. Because of the resistance layer and contact arrangement employed, the heating element, pipe, transportation device and roller according to the invention can be operated, both with low voltages of for instance 24 V and with very high voltages of for instance 240, 400 and up to 1000 V.

With the heating element and its use heating powers per unit area in excess of 10 kW/m$^2$, preferably in excess of 30 kW/m$^2$, even up to 60 kW/m$^2$ can be achieved according to the invention with a 1 mm thick resistance layer. The time-dependent drop in heating power can be smaller than 0.01% per year when a voltage of 240 V is continuously applied.

The temperature that can be achieved with the heating element is limited by the thermal properties of the polymer selected, but can be higher than 240° C. and up to 500° C. The polymer should in particular be so selected that even at the temperatures to be achieved, conduction continues to be electronic.

The heating element can have the most diverse shapes such as a square shape, or the shape of a tape, the electrodes being strips extending over the fall length of the tape and are arranged side by side in the direction of the width of the heating element.

It is also within the scope of the invention to use a material for the resistance layer that has—at least over some range of temperatures—a negative temperature coefficient of electric resistance in which case a very small making current is required. The material of the resistance layer may be selected so that at a particular temperature, for instance at 80° C., the resistive mass reverts so that above this temperature the temperature coefficient of the electric resistance becomes positive.

One object of the invention is reached by a pipe coated on its outside at least in part, directly or via an interlayer, with a thin resistance layer containing an intrinsically electro-conductive polymer according to the invention, and where on the outer surface of the resistance layer at least two flat electrodes are arranged at a distance from each other which cover the resistance layer at least in part. Here the unilateral contact arrangement of the heating element is a particular advantage, since heat transfer from the heating element to the pipe is not hindered by contact terminals. The electrical insulation between the body to be heated and the heating element is also simplified by the lack of contact points on the electro-conductive layer.

The long-term stability or aging resistance of the intrinsically electro-conductive polymer is of particular significance for heatable pipes which are used for instance underground or in other places not readily accessible, so that frequent repairs are undesirable if not impossible.

With the heating element according to the invention, pipes are easy to heat by being provided with the resistance layer and the electrodes, and if required with the interlayer, already at the place of manufacture and being incorporated into the pipeline on the spot in this finished state. In one embodiment, the pipe has an interlayer made of a material having a high electric conductivity between the pipe and the resistance layer. The interlayer can be insulated from the pipe by foils. The insulation of the interlayer, which is not provided with contacts, can occur with known foils consisting of polyimide, polyester and silicone rubber.

As already mentioned, the pipe can withstand even high stresses without giving rise to a local temperature rise. As a rule, the mechanical stress acting on a pipe laid underground is directed radially. This is the direction of current flow in the resistance layer of the heating element. Such a stress will therefore not lead to an increase in resistance in places where pressure is exerted, contrary to heating elements where the current would flow in the direction normal to the compressive load.

In a further embodiment of the heatable hollow structure, e.g. pipe or container, according to the invention, the resistance layer is arranged directly on the outer surface of the structure if it consists of an electro-conductive material.

In this embodiment, the flow of current from one electrode to the next is directed via the resistive mass and the pipe. In view of the low voltages prevailing in the resistance layer according to the invention, the pipe here functions as a floating electrode and can be adduced without safety risks as a current conductor. In this embodiment, the heat generated can at the same time readily be transferred to the medium present in the pipe. In this version, the pipe can be covered with the resistance layer over its entire periphery, and the electrodes can cover this layer completely except for the gap between the electrodes that must be provided for electrical reasons.

According to a further embodiment, the resistance layer and the electrodes arranged on this layer extend longitudinally in an axial direction, and the electrodes are arranged on the resistance layer at small distances from each other in the direction of the circumference. In view of the longitudinal extension of the resistance layer and the electrodes, a certain length of pipe can be heated while the current supply is needed only in a single point of each of the two electrodes.

In another embodiment, the resistance layer covers only part of the periphery of the pipe and extends longitudinally in an axial direction. Preferably, the length of the resistance layer and electrodes corresponds to that of the pipe. In this embodiment, heat can be transferred to the pipe within a predetermined region where the resistance layer or, if present, the interlayer is applied to the pipe, e.g. on the lower side of the pipe that for instance is laid underground. This guarantees that even in a pipe not completely filled, the medium to be heated is in contact with this partial zone and thus is heated reliably and rapidly.

In the case of pipes having good thermal conductivity, the heat transferred from the resistance layer is distributed over the full periphery of the pipe and thus can heat the medium present in the pipe to the fall extent. This structure thus provides good heating of the medium while requiring little engineering effort. However, this embodiment is only possible when heating element according to the invention is applied to the pipe. Only such a structure makes it possible to achieve high power per unit area while avoiding any damage to the resistance layer during extended operation and under the influence of reactive substances such as water or oxygen.

As already mentioned, the electrodes and/or the interlayer preferably consist of a material with a very low electric. This is of particular significance in the application of the invention on pipelines since there the resistance layer and the electrodes are very long. Thus, a voltage drop across the electrode surface which would lead to an overall decrease in power can be avoided. Moreover, the high conductivity guarantees a rapid distribution of the current within the electrode, which permits a rapid and uniform heating-up of essentially the entire resistance layer and thus the length of the pipe while it is not necessary to apply voltage to the electrodes in several points along their length or width. It may then not be necessary to arrange power supply lines along the pipe. According to the invention, an arrangement with multiple contact points is only selected in embodiments where the pipe is very long. The limiting length above which a multiple contact arrangement will be meaningful depends both on the material and thickness of the electrodes and on the place of the contacts. Thus, multiple contact points may be unnecessary even for lengths more important than those mentioned above when the electrodes are accessible in the midpoint of their length, and a contact can be provided at that point.

Small layer thicknesses are also advantageous in that the heat produced by the heating element can readily be transferred from the interlayer to the pipe. Moreover, thin electrodes are more flexible, so that a detachment of the electrodes from the resistance layer and thus an interruption of the electrical contact during thermal expansion of the resistance layer will be avoided.

In long pipelines a multiple contact arrangement may yet be necessary which, however, can easily be provided with the heating element according to the invention. The electrodes are only provided with contact terminals from the outside, so that these are readily accessible. Thus, a power line extending along the pipe and connecting the electrodes at intervals to the voltage source can be provided along the pipeline. This makes it possible to operate long pipelines according to the invention.

The invention applied to a pipe or pipeline is explained in the following by means of the accompanying drawings which show in FIG. 4 a sectional view of a pipe without a thermal insulation layer, and in FIG. 5 a sectional view of a pipe with thermal insulation layer.

Figure 4:
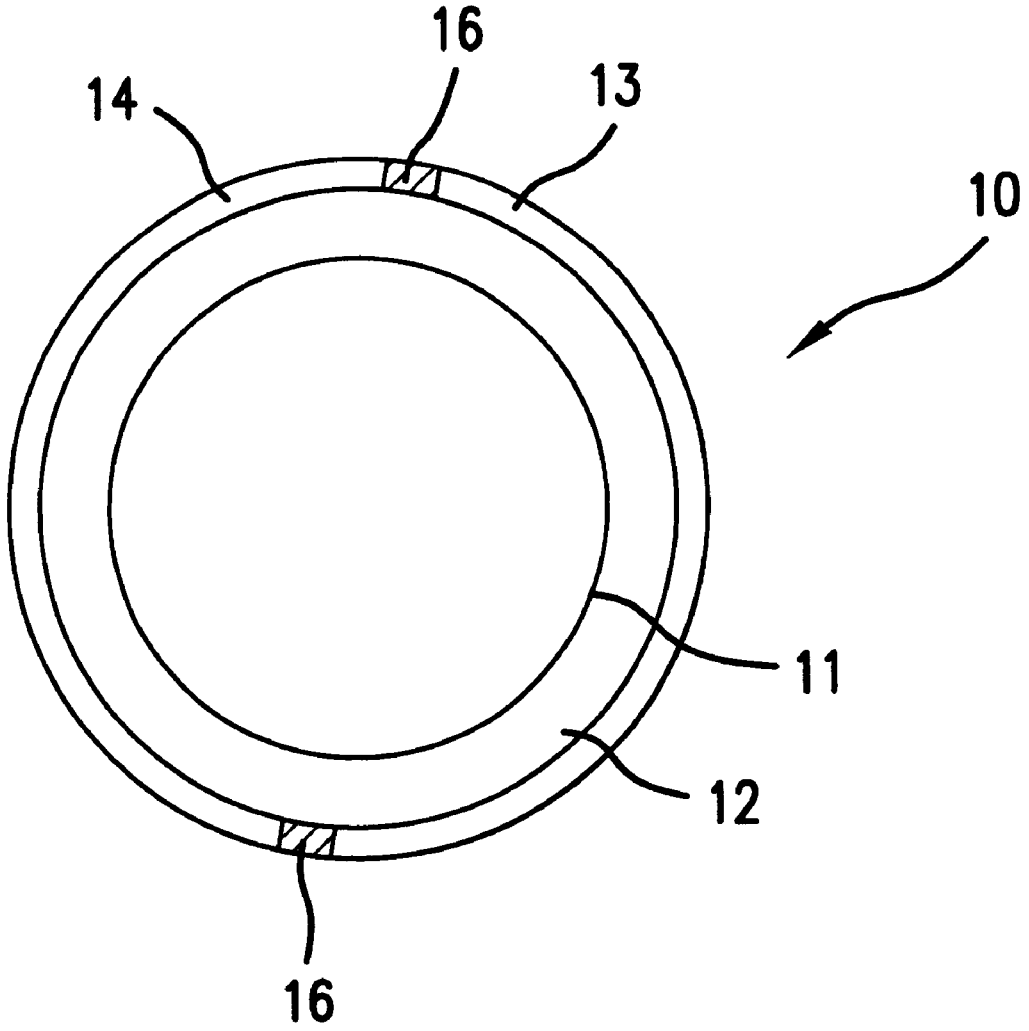

In FIG. 4 the arrangement 10 consists of a pipe 11 carrying a resistance layer 12 on its surface over its entire periphery. Two flat electrodes 13 and 14 separated from each other by an electrical insulation 16 are arranged on the resistance layer 12. When a current is applied from a source of current (not shown) to the electrodes 13, 14, it flows from the one electrode 13 through the resistance layer 12 to the pipe 11. In this embodiment, the pipe 11 preferably consists of an electro-conductive material. The current is conducted within the wall of the pipe 11 and flows through the resistance layer 12 to the second electrode 14. The entire resistance layer 12 is heated up by this heating current and can transfer this heat via the pipe 11 to the interior of the pipe.

Figure 5:
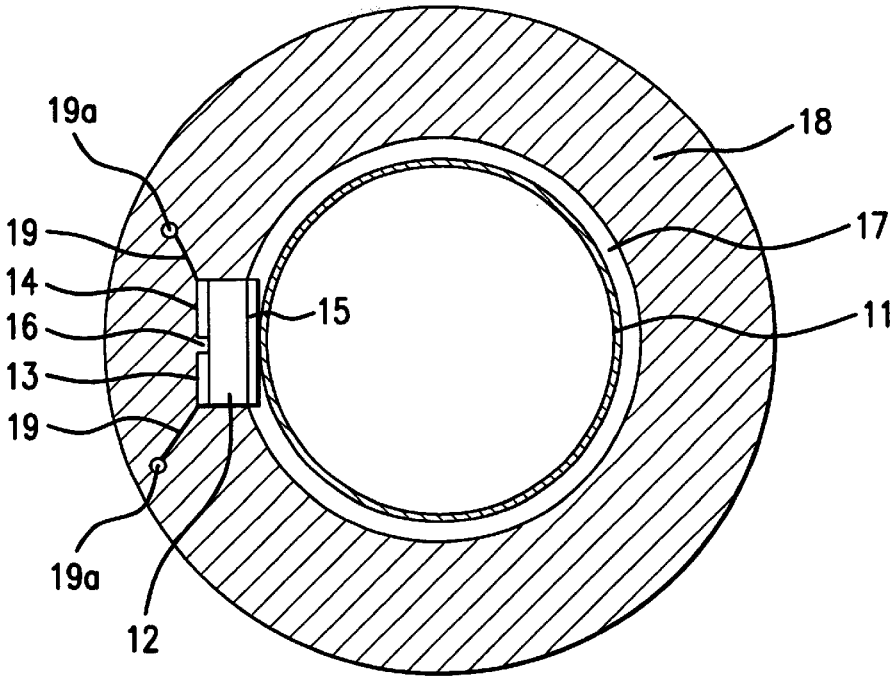

In FIG. 5, a heating element 12, 13, 14, 15, 16 is applied to a part of the periphery of the pipe 11. This element has a flat electro-conductive layer 15 facing the pipe 11 and is covered by a resistance layer 12 on the side facing away from the pipe 11. On the resistance layer 12, two electrodes 13 and 14 are arranged at a distance from each other. Across the region not in contact with the heating element, the pipe 11 is covered by a thermal insulation layer 17. Around this thermal insulation layer 17, an insulating shell 18 is arranged which encloses both the thermal insulation layer 17 and the heating element 12, 13, 14, 15, 16. Power supply installations 19 are connected with supply lines 19*a* running parallel to the axis of the pipe 11 through the insulating shell 18. These supply lines 19*a* extend over the entire length of the pipe and at the end of the pipe can be connected to a source of current (not shown) or linked with the supply lines 19*a* of the following pipe. Materials which will enhance the heat transfer can be provided between the pipe 11 and the electro-conductive layer 12 facing the pipe 11. These materials can be thermally conducting pastes, pads with thermally conducting material, silicone rubber, etc. However, in this embodiment the heating element 12, 13, 14, 15, 16 can also be adapted to the curvature of the pipe 11, which guarantees an immediate heat transfer.

In the embodiments shown, the electrodes 13, 14 extend in the longitudinal direction of the pipe and peripherally are arranged side by side. It is also within the scope of the invention that electrodes 13 and 14 are so arranged on the resistance layer 12 that they extend peripherally but are arranged side by side in an axial direction.

With the supply lines running parallel to the pipe axis, several pieces of pipe can be arranged in series while the power supplies of the individual heating elements of the pipe pieces are arranged in parallel.

It is within the scope of the invention to lay the supply lines on the outer surface of the insulating shell and connect them via the power supply installations to the electrodes of the heating element. The terminals for current supply to the heating element are provided as needed, by insulated braids having any desired length or by permanently glued contact terminals using known systems for the connections.

Pieces of a pipe can optionally be linked with further pipes or with conventional, not heatable pipe pieces to form a pipeline. It is thus possible to only heat those segments of the pipeline where a particular temperature must be set, for instance in order to avoid freezing. The costs of a pipeline can be optimized when using this selective heating.

It is also possible to provide just part of the length of a pipe with a heating element according to the invention. One or several heating elements may be arranged within the thermal insulation layer of the pipe, for instance in several longitudinal grooves of the insulation layer, and may extend in a radial or axial direction.

A cathodic protecting voltage can be generated at the pipe which will prevent corrosion of the pipe when direct current is applied to the electrodes of the heating element and the pipe is made of an electro-conductive material.

A conventional pipe may be surrounded by two half-shells preferably made of insulating material such as glass fibers or plastic foam where at least one of the half-shells comprises a heating element.

A further object of the invention is achieved by applying the heating element to a heatable transportation device for media comprising a container receiving the medium, where the container on its outer surface is covered at least in part, either directly or via an interlayer, with a thin resistance layer containing an intrinsically electro-conductive polymer and where at least two flat electrodes which cover the resistance layer at least in part are arranged at a distance from each other on the outer surface of the resistance layer.

In view of the longitudinal extension of the heating element formed by the resistance layer and the electrodes and, where present, the interlayer, it is possible to merely heat a particular region of the container, while power supply is only needed at one point of each of the two electrodes.

Figure 7:
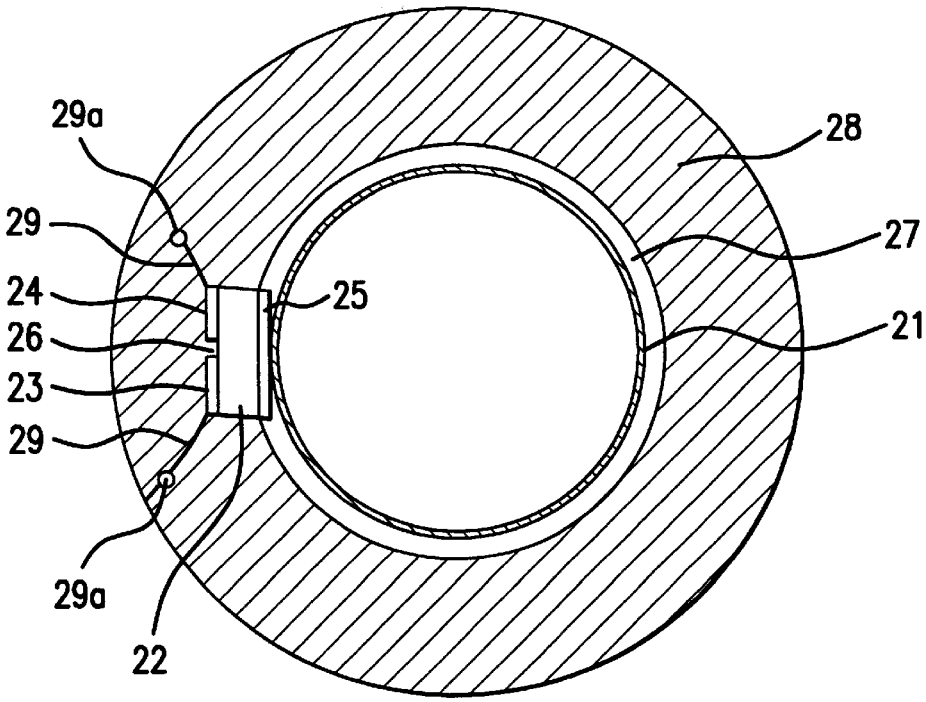
Figure 8:
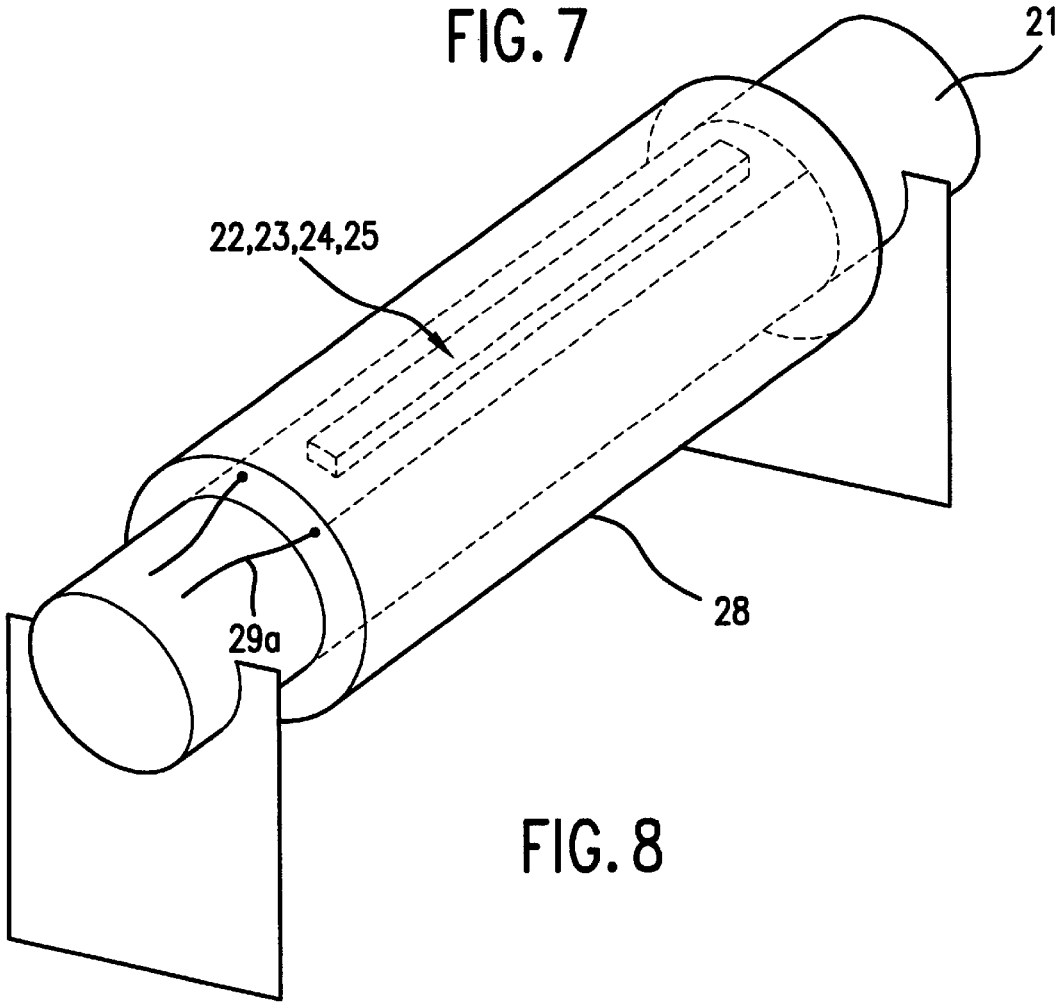

The invention applied to a transportation device or container is explained in the following by means of the accompanying drawings which show FIG. 6 a sectional view of a device without thermal insulation layer;

FIGS. 7 and 8 a sectional and a perspective view respectively of a heating element incorporated into a thermal insulation layer.

Figure 6:
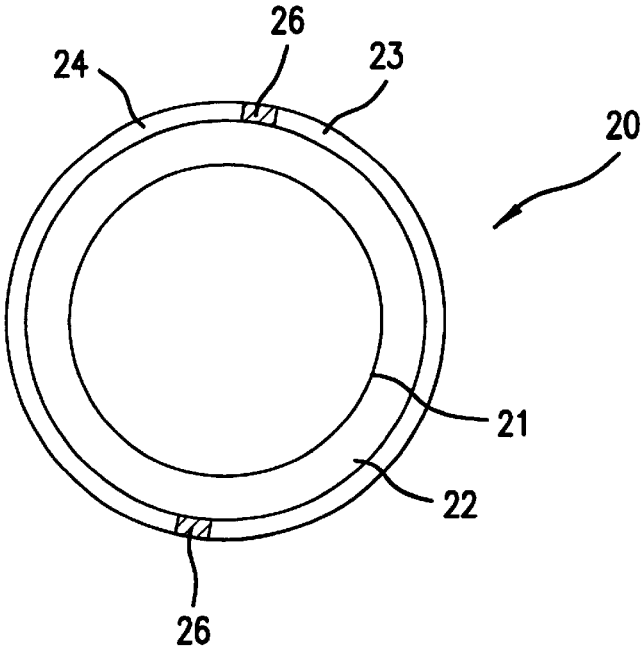

In FIG. 6 the device 20 consists of a tubular container 21 and a resistance layer 22 which covers the entire periphery of the container 21. Two flat electrodes 23 and 24 separated from each other by an electrical insulation 26 are arranged on the resistance layer 22. Current applied from a source of current (not shown) to the electrodes 23, 24 will flow from the one electrode 23 through the resistance layer 22 to the container 21. In this embodiment the container 21 preferably consists of an electro-conductive material. The current is conducted along the wall of the container 21 and flows through the resistance layer 22 to the second electrode 24. The entire resistance layer 22 is heated up by this heating current and can transfer this heat via container 21 to the interior of the container In FIG. 7 a heating element is applied to part of the periphery of a tabular container 21. This element has a flat electro-conductive layer 25 facing the container 21 and is covered with a resistance layer 22 on the side facing away from the container 211. Two electrodes 23 and 24 are arranged at a distance from each other on the resistance layer 22. Over the region not in contact with the heating element, the container 21 is covered by a thermal insulation layer 27. An insulating shell 28 which surrounds both the thermal insulation layer 27 and the heating element 22, 23, 24, 25, 26 is arranged around the thermal insulation layer 27. The device further contains power supply installations 29 which are connected to supply lines 29*a* running parallel to the axis of the tubular container 21 through the insulating shell 28. These supply lines 29*a* extend over the entire length of the insulating shell 28 and at its end can be connected to a source of current (not shown) or linked with the supply lines 29*a* of a further insulating shell 28 with the heating element and thermal insulation layer 27 arranged on the container 21. Materials improving the heat transfer may be provided between the container 21 and the electro-conductive layer 25 facing the container 21 in a similar way as above described for pipes.

In the embodiments shown, the electrodes 23, 24 extend in the longitudinal direction of the container 21 and peripherally are arranged side by side. It is within the scope of the invention, too, to arrange electrodes 23, 24 on the resistance layer 22 in such a way that they extend in the peripheral direction of the container 21 and are arranged side by side in axial direction.

The supply lines running parallel to the container axis make it possible to arrange several insulating shells with a heating element and a thermal insulation layer in series on the container and to arrange the power supplies of the individual heating elements in parallel. The supply lines are protected against damage or contact with water for instance by the insulating shell.

The heating element is preferably arranged within the insulating shell in such a way that it adjoins the container from below. This position of the heating element has the advantage that heat can readily be transferred from the heating element, even to a container which is filled only to a small extent.

In FIG. 8, the container 21 is surrounded by an insulating shell 28 over a major part of its length. The heating element 22, 23, 24, 25, 26 as well as the supply lines 29*a* and the power supply installations 29 are arranged within the insulating shell 28. The heating element extends over a major part of the length of the insulating shell 28 and terminates within the insulating shell 28. The supply lines 29*a* protrude at the end of the insulating shell and can be connected to a source of current (not shown). The fastening devices with which the transportation device according to the invention can be arranged on a railroad car or truck are shown schematically in FIG. 8. These fastening devices preferably are arranged in such a way that neither the insulating shell nor the heating element is exposed to compressive stresses when the container rests on the fastening devices.

Preferably, the container is tubular. However, it can also have other shapes, for instance a rectangular cross section.

A heating element as shown in FIG. 2 can also be used according to the invention in order to heat a hollow structure as mentioned above. The side of the heating element on which the contacted electrodes are arranged is facing in a direction away from the pipe or container. The electrical dimensions of the heating element are determined in accordance with FIG. 3 and the associated mathematical relations. The side of the heating element on which the electrodes are arranged is facing away from the pipe or container. In the case of a pipe or a cylindrical container, the electrodes and floating electrodes are preferably arranged in such a way that they extend in the direction of the pipe or container axis and are peripherally spaced on the outside of the pipe or container. Several zones are thus formed peripherally within which lower voltages prevail than the applied voltage.

The pipe or container can consist for instance of metal or plastic, and preferably of polycarbonate. The heating element can comprise an interlayer between the pipe or container and the resistance layer when a material without electrical conductivity is selected for the pipe or container. However, it is also within the scope of the invention to provide a heating element for such a pipe or container which only comprises the electrodes and the resistance layer. In this embodiment the heating current is conducted from the one electrode to the other electrode through the resistive mass of the resistance layer, i.e., through the electro-conductive polymer. This current path is feasible with the device according to the invention since the structure of the polymers secures sufficiently large current flow through the resistive mass and thus a sufficient heat production.

It is also possible to provide just part of the length of the pipe or container with the insulating shell which comprises a heating element and a thermal insulation layer. Further, depending on the particular application, the size of the heating element can be selected so that one or several heating elements can be arranged within the thermal insulation layer. In the case of a pipe or a tubular container, these can extend in a radial or axial direction. Here the heating elements can for instance be arranged in several longitudinal grooves of the insulation layer.

The supply lines are protected by the insulating shell against damage or contact, for instance with water. The thermal insulation layer has also the purpose to avoid heat losses by radiation in a direction away from the pipe or container and to direct the heat generated by the heating element predominantly in the direction of the pipe or container. The thermal insulation layer can consist of insulating materials and in addition, where necessary, of a reflective layer.

It is possible, too, that the entire pipe or container is surrounded by the thermal insulation layer while the resistance layer as well as the flat electrodes and the interlayer are arranged within a longitudinal groove of the thermal insulation layer that faces the pipe or container. In this embodiment, heat can be transferred to the pipe or container across a specific region where the heating element is adjoining the pipe or container. At the same time, heat losses across the remaining region of the pipe or container are prevented by the thermal insulation layer. By arranging the heating element within the thermal insulation layer, good contact between this layer and the container across the remaining region is guaranteed. Such an embodiment can also be used for devices where the pipe or container has a good thermal conductivity in which case the heat generated by the heating element is distributed over the entire surface area of the pipe or container wall and can thus additionally heat the medium present in the pipe or container. With this structure one thus achieves, on one hand a heating of the medium by infrared radiation coming from the heating element, and on the other hand a direct heating by the heating element and the pipe or container wall.

The embodiments shown can additionally be provided with clamping devices. Optionally, these clamping devices can be mounted externally on each of the devices according to the invention that are represented, for instance with adhesive tape or locking rings, or in the embodiments shown in FIGS. 5, 7 and 8, they can also be arranged directly on the outer surface of the heating element. In this latter case the devices can consist of foam rubber. In particular, inflatable or foamable chambers can be provided on the side of the heating element facing away from the pipe (especially if it has a large diameter) or from the container. The clamping devices guarantee a constant clamping pressure and hence a good heat transfer from the heating element to the pipe or container.

The pipe or container may consist of metal or plastic, and particularly of polycarbonate. The heating element may comprise an interlayer between the pipe or container on one hand and the resistance layer on the other hand when a non-conductive material is used for the pipe or container. However, it is also within the scope of the invention to provide a heating element for such a pipe or container which only comprises the electrodes and the resistance layer. In this embodiment the heating current is conducted from one electrode to the other through the resistive mass of the resistance layer, i.e., through the electro-conductive polymer. Such a current path is feasible with the heating element according to the invention since the structure of the polymers secures sufficiently large current flow through the resistive mass and thus a sufficient heat production.

A still further object of the invention is achieved by applying the heating element according to the invention to the inner surface of a heat roller shell. Due to the sufficient flexibility of the heating element it is readily applied to the inner surface of a roller and allows to generate heat uniformly over a large area. In operation, the heating element on the inner surface of the roller shell is protected against mechanical stress.

The heating element can moreover serve as "black body" which can emit radiation of all wavelengths. The wavelength of the emitted radiation shift more and more towards the infrared as the temperature decreases. The infrared radiations of the roller can act upon the goods to be heated when the roller is made of a material that transmits these radiations, such as glass or plastic. Due to the effect of the infrared radiation high temperatures are not required in the resistance layer itself.

In one embodiment, the resistance layer is arranged between the electrodes which are connected to a source of current and cover the resistance layer at least in part. In this embodiment the roller shell itself may for instance serve as one of the electrodes. The resistance layer is then applied in predetermined thickness, directly to the inner surface of the roller. A counter-electrode will then be arranged on the side of the resistance layer that is facing away from the roller shell. The heating current applied to the electrode and to the roller shell serving as an electrode flows through the resistive mass, essentially across its thickness. This structure guarantees a good heat transfer to the goods to be heated, because the roller shell is in direct contact with the resistance layer.

However, in this embodiment it is also possible that on the inner surface of the roller shell a flat electrode is arranged which on its side facing away from the roller shell is covered with a resistance layer. The other electrode is then arranged on top of this resistance layer. Here the heating current flows between the two electrodes, and the roller surface can remain voltage-free. This embodiment is advantageous primarily in applications where a direct contact between the heat roller and for instance the user of the device can occur.

According to a further embodiment, the at least two flat electrodes are arranged at a distance from each other on the side of the resistance layer facing away from the roller shell.

According to the invention, the roller is contacted by two electrodes arranged on one side of the resistance layer. In this contact arrangement the operating mode of the intrinsically conductive polymers used according to the invention can be exploited particularly advantageously. The applied current first spreads within the first electrode, then flows along the polymer structure through the thickness of the resistance layer, essentially in a direction normal to the surface, and finally is conducted to the second contacted electrode. The current path thus is additionally extended relative to that in a structure where the resistance layer is sandwiched between the two electrodes. Because of this current path, the thickness of the resistance layer can be kept particularly small.

This embodiment of the roller according to the invention has the further advantage that the electrodes are provided with contacts on one side of the resistance layer. This side faces away from the roller shell and hence is readily accessible for providing contact terminals. The opposite side of the resistance layer which faces the roller shell is free of contact terminals. Such a smooth surface permits a direct application of the resistance layer to the roller shell. An ideal heat transfer to the roller shell of up to 98% becomes possible since the contact area between the resistance-heating layer and the body to be heated is not disrupted by contact terminals. In addition, a uniform heat transfer can reliably occur from the heating element to the roller shell and thus to the goods to be heated.

On the side of the resistance layer facing away from the electrodes, an interlayer made of a material with high electric conductivity can be provided between the resistance layer and the roller shell. This interlayer serves as a floating electrode. However, it is also within the scope of the invention when in this embodiment the resistance layer is applied directly to the roller shell. An electrical insulation of the interlayer or resistance layer from the roller shell can also be realized by simple means, for instance a foil.

The heatable heat roller has the further advantage that the resistance layer arranged on the roller shell can withstand even high stresses without giving rise to a local temperature rise. As a rule, the mechanical stress acting on the roller shell is directed radially. This is the direction of current flow in the resistance layer of the heating element. Such a stress will therefore not lead to an increase in resistance in places where pressure is exerted, contrary to heating elements where the current would flow in a direction normal to the compressive load.

According to the invention, electrodes which are applied to the side of the resistance layer facing away from the roller shell can essentially extend over the full periphery and can be spaced in an axial direction. This arrangement is advantageous, since in a heat roller which is in rotary motion when in service, a current supply can occur from the two roller ends.

According to a further embodiment of the invention, the resistance layer can have a structure in which layers of different resistive materials with different specific electric resistances are present. In this embodiment the side of the resistance layer facing the interior of the roller can consist of a material having a low resistance. On top of this layer, further layers of materials having specific resistances increasing from one layer to the next are applied. In this arrangement, the side facing the roller shell has the highest specific resistance of the resistance layer, so that this surface heats up more strongly, since here the largest voltage drop occurs.

The heat roller with a heating element according to the invention is particularly adapted to be used as a copying roller in photocopying equipment or as a foil coating roller for the sealing of materials with foils. Such heat rollers must heat up quickly, and have a uniform temperature over their entire length. The electrode material according to the invention is able to avoid a voltage drop across the surface of the electrode which would lead to an overall performance drop and to temperatures which differ across the surface. The high conductivity also guarantees a rapid spread of the current within the electrode in turn permitting a rapid, uniform heating-up of essentially all of the resistance layer and hence of the length of the roller while it is not necessary that voltage is applied at a number of points along the length or width of the electrodes.

Figure 10:
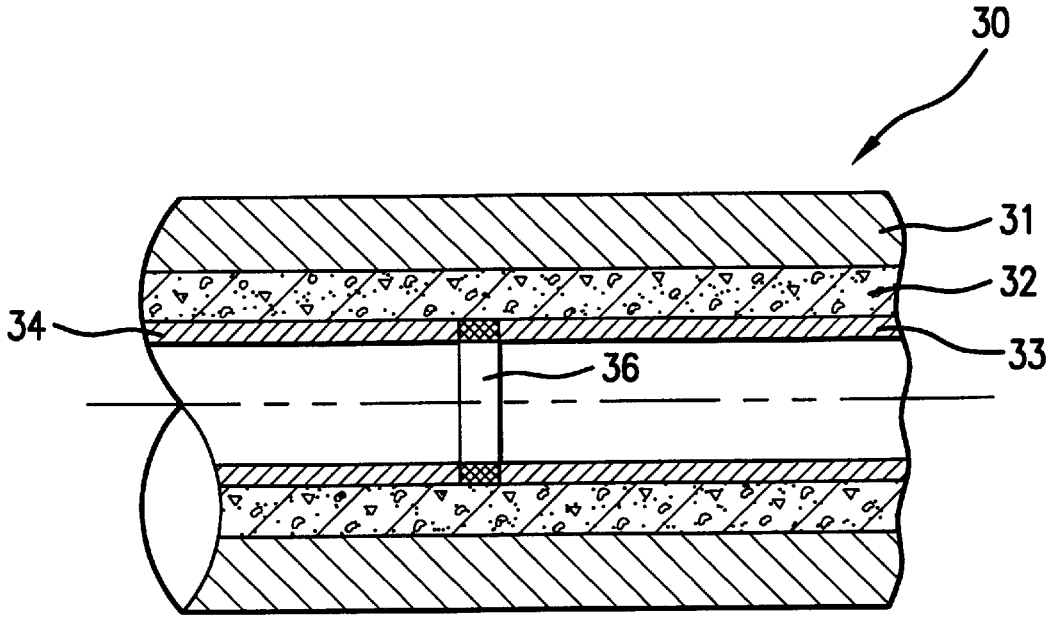

The invention applied to a heat roller is explained in the following by means of the accompanying drawings which show in FIG. 9 a heat roller according to the invention having a resistance layer sandwiched between the electrodes;

in FIG. 10 a longitudinal section of a heat roller according to the invention with two electrodes arranged side by side on one side of the resistance layer.

Figure 9:
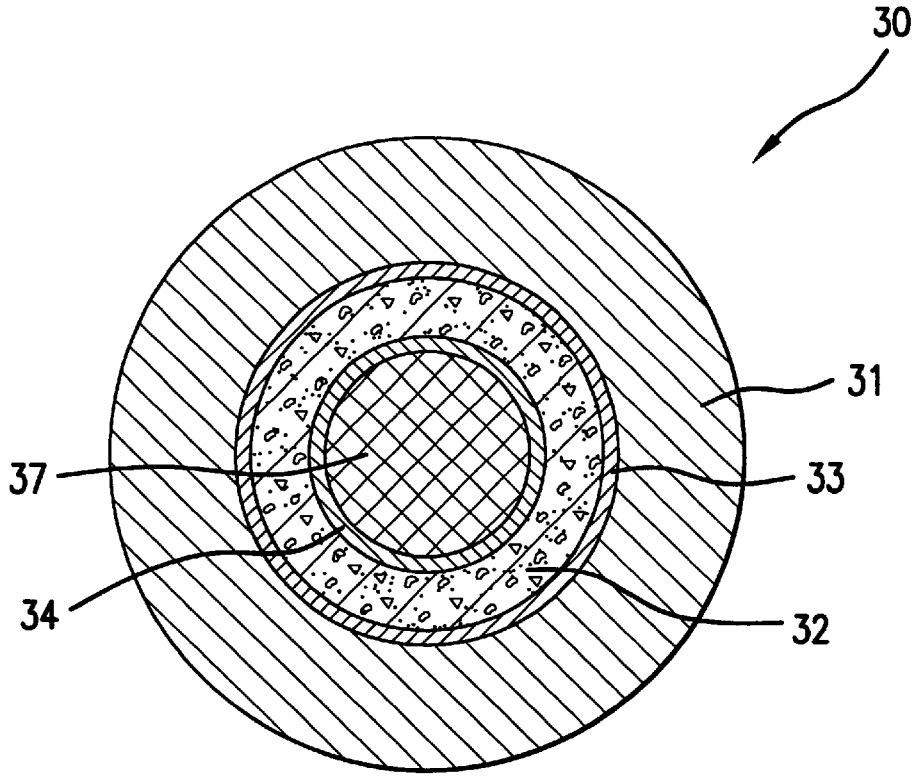

FIG. 9, a heat roller 31 is shown where the inner surface of the roller shell 31 is covered by a flat electrode 33. The resistance layer 32 is arranged on this electrode 33 and has a further electrode 34 on the side facing away from the electrode 33. In the interior of the roller, a thermal insulating material 37 is arranged which completely fills the interior of the heat roller and adjoins the inner electrode 34. In the embodiment represented, the electrodes 33 and 34 are connected to a source of current (not shown). The current flowing through the resistance layer 32 heats this layer and thus leads to a heating of the roller shell 31.

FIG. 10 represents an embodiment of the heat roller 30 according to the invention. In this embodiment the resistance layer 32 is arranged directly on the roller shell 31 and is covered essentially completely by two electrodes 33 and 34 on its side facing away from the roller shell 31. The electrodes 33 and 34 are electrically separated from each other by an insulation 36 which may comprise conventional dielectrics such as air or plastic.

The electrode 34 can be connected with the source of current (not shown) on the left-hand side of the copying roller, the electrode 33 can be connected on the right-hand side. In this embodiment, the heating current flows from the first electrode 33 to the roller shell, which preferably consists of a material which is a good electric conductor, and then back from the roller shell through the resistive mass 33 to the other electrode 34 or vice versa.

If the at least two electrodes are arranged on one side of the resistance layer and an interlayer consisting of a material with high conductivity is provided on the opposite side, the heating current will flow from one electrode through the resistance layer to the interlayer, further through this layer, and then through the resistance layer to the other electrode.

However, on account of the resistive material, it will also be possible to work without an interlayer, even where the roller shell consists of a non-conductive material. In this case the heating current flows through the resistance layer, where because of the polymer structure the entire resistive mass heats up. Finally, even the roller shell can consist of conductive material and serve to conduct the current. The current applied to the electrodes then flows from one electrode through the resistive mass, further through the roller shell, and then through the resistive mass to the other electrode.

In all these embodiments where the current is fed to the resistive mass from one side, the voltage prevailing in the zones is reduced to half that with two-sided current supply.

The distance provided between the electrodes acts as an additional resistance in parallel. With air as the insulator 36, the resistance is determined by the distance between the electrodes and thus by the surface resistance.

It is also possible to use a heating element as in FIG. 2. This heating element is used in the heat roller according to the invention in such a way that the side of the heating element on which the contacted electrodes are arranged is facing away from the roller shell. The electrical dimensions are determined according to FIG. 3 and to the associated mathematical relations.

Known electrical insulation films such as of polyester, polyimide and other materials can be provided between the heating element and the roller shell if it is desired to keep the surface of the heat roller voltage-free. Power supply to the electrodes is provided preferably by known contact-making technologies in the case of flat heating elements or via slip rings or bearings serving as electrical contact terminals.

Depending on the particular application, metal foils or sheets can for instance be used as electrodes. It is also within the scope of the invention to clamp the heating element by clamping devices to the roller shell. Locking rings which can simultaneously serve as electrodes can for instance be used as a clamping device. Thermoplastics in the form of foils or heat-conducting pastes can be provided between the heating element and the roller shell in order to improve the heat transfer between the heating element and the roller shell.

In the roller according to the invention, several heating elements which are spaced apart and distributed over the length of the roller can be provided inside the roller. It is also within the spirit of the invention, however, to provide inside the roller one continuous resistance layer to which several electrodes are applied in the form of segments. These segments extend over the fall inner periphery of the roller shell that is covered by the resistance layer, and can readily be introduced into the roller. They thus permit a rapid assembly. It is moreover possible to achieve heating of individual regions of the roller by providing in the heat roller a number of electrodes acting as electrode pairs which are alternatively supplied with current. These electrodes, too, preferably extend over the full periphery and are spaced apart in an axial direction. For instance, the marginal regions of the roller can be heated separately when the heat roller is used as a foil coating roller. This additional heat supply can provide a uniform temperature distribution over the region in contact with the goods to be heated, since a temperature drop along the margins is balanced by the additional heating.

In the interior of the roller, a thermal insulating material which, if necessary, can completely fill the interior of the roller can be provided on the side of the electrodes facing away from the resistance layer. This thermal insulating material prevents a radiation of heat from the heating element toward the interior of the roller and hence an accumulation of heat inside the roller.

In general, according to the invention, polymers which are conductive through metal or semimetal atoms attached to the polymers can be used in particular as the electro-conductive polymer in the resistance layers of the heating element, e.g. when supplied to a hollow structure. The polymers preferably have a specific resistance to current flow in the range of values attained with semiconductors, such as up to $10^2$ and preferably at most $10^5$ Ω·cm. Such polymers can be obtained by a process where metal or semimetal compounds or their solutions are added to polymer dispersions, polymer solutions or polymers in such an amount that approximately one metal or semimetal atom is present per polymer molecule. To this mixture a reducing agent is added in a small excess, or metal or semimetal atoms are formed by known thermal decomposition. The reducing agent is added in a ratio such that the ions can be completely reduced. After that the ions formed or still present are washed out while graphite or carbon black can, if necessary, be added to the dispersion solution or granulated material.

The electro-conductive polymers used according to the invention are preferably free of metal ions or show a maximum content of free ions of 1 wt. % related to the total mass of the resistance layer. This leads to a long-term stability and age-resistance of the resistance layer even under prolonged current flow.

Reducing agents for the above mentioned process are those which either will not form ions because they are thermally decomposed during processing, such as hydrazine, or which chemically react with the polymer itself, such as formaldehyde, or reducing agents such as hypophosphite, where an excess or reaction products are readily washed out. Preferred metals or semimetals are silver, arsenic, nickel, graphite or molybdenum. Metal or semimetal compounds which yield the metal or semimetal atoms without disturbing reaction products by purely thermal decomposition are particularly preferred. Arsenic hydride or nickel carbonyl have been found to be particularly advantageous. The electro-conductive polymers used according to the invention can for instance be prepared by adding to the polymer a premix prepared according to one of the following formulations in an amount of 1 to 10 wt. % (referred to the polymer).

EXAMPLE 1

1470 parts by weight of a dispersion of fluorohydrocarbon polymer (55% solids in water), 1 part by weight of wetting agent, 28 parts by weight of 10% silver nitrate solution, 6 parts by weight of chalk, 8 parts by weight of ammonia, 20 parts by weight of carbon black, 214 parts by weight of graphite, 11 parts by weight of hydrazine hydrate.

EXAMPLE 2

1380 parts by weight of a 60% acrylic resin dispersion in water, 1 part by weight of wetting agent, 32 parts by weight of 10% silver nitrate solution, 10 parts by weight of chalk, 12 parts by weight of ammonia, 6 parts by weight of carbon black, 310 parts by weight of graphite, 14 parts by weight of hydrazine hydrate.

EXAMPLE 3

2200 parts by weight of distilled water, 1000 parts by weight of styrene (monomer), 600 parts by weight of ampholytic soap (15%), 2 parts by weight of sodium pyrophosphate, 2 parts by weight of potassium persulfate, 60 parts by weight of nickel sulfate, 60 parts by weight of sodium hypophosphite, 30 parts by weight of adipic acid, 240 parts by weight of graphite.

I claim:

1. Flat heating element comprising a thin resistance layer containing an electroconductive polymer and at least two flat electrodes arranged on one side of the resistance layer at a distance from each other, wherein the polymer has an intrinsic electric conductivity caused by the content of at least one metal or semimetal atom dopant and wherein the ratio between atoms of the dopant and the number of polymer molecules is between 2:2 and 10:1.

2. Flat heating element comprising a thin resistance layer containing an electro-conductive polymer and at least two flat electrodes arranged on one side of the resistance layer at a distance from each other, wherein the polymer has an intrinsic electric conductivity caused by the content of at least one metal or semimetal atom dopant, wherein the resistance layer in addition contains graphite particles and wherein the graphite particles are present in an amount of at most 5 percent by volume, referred to the total volume of the resistance layer, and have an average diameter of at most 0.1 $\mu$m.

3. Flat heating element comprising a thin resistance layer containing an electro-conductive polymer and at least two flat electrodes arranged on one side of the resistance layer at a distance from each other, wherein the polymer has an intrinsic electric conductivity caused by the content of at least one metal or semimetal atom dopant, wherein the resistance layer is applied to the surface of a hollow structure having an axis and selected from the group consisting of a pipe, a container and a heat roller shell, the flat heating element further comprising a power supply installation extending in axial direction outside the hollow structure over its entire length and being connected with each of the electrodes in at least two contact points.

4. Heating element according to claim 1, wherein a flat floating electrode is arranged on the side of the resistance layer that is opposite to the two flat electrodes.

5. Heating element according to claim 4, wherein the electrodes consist of a material with a specific electric resistance of less than $10^{-4}$ $\Omega$·cm, preferably of less than $10^{-5}$ $\Omega$·cm.

6. Heating element according to claim 4, wherein the electrodes have a thickness in the range of 50 to 150 $\mu$m.

7. Heating element according to claim 6, wherein the electrodes have a thickness in the range of 75 to 100 $\mu$m.

8. Heating element according to claim 1, wherein the resistance layer has a thickness of 0.1 to 2 mm.

9. Heating element according to claim 8, wherein the resistance layer has a thickness of about 1 mm.

10. Heating element according to claim 1, wherein the resistance layer has a positive temperature coefficient of electric resistance.

11. Heating element according to claum 1, wherein the resistance layer is metallized on its surfaces facing the electrodes and/or the floating electrode.

12. Heating element according to claim 1, wherein the distance between the electrodes is about twice the thickness of the resistance layer.

13. Heating element according to claim 1, wherein the content of free ions in the resistance layer is at most 1 percent by weight referred to the total weight of the resistance layer.

14. Heating element according to claim 1, wherein the polymer is selected from the group comprising polyamides, polymethyl metacrylates, epoxides, polyurethanes and polystyrene.

15. Heating element according to claim 1, wherein the resistance layer comprises a support material.

16. Heating element according to claim 15, wherein the support material is a flat porous, electrically insulating material.

17. Heating element according to claim 1, wherein the resistance layer comprises more than one layer, each of said layers being composed of different resistive materials with different specific electric resistances.

18. Heating element according to claim 3, wherein an interlayer composed of a material having a high electrical conductivity is arranged between the hollow structure and the resistance layer.

19. Heating element according to claim 3, wherein the resistance layer is metallized at its surfaces facing the electrodes and the interlayer.

20. Heating element according to claim 3, wherein the resistance layer is arranged directly on the surface of the hollow structure which comprises a material having a high electric conductivity.

21. Heating element according to claim 3, wherein the resistance layer and the electrodes arranged on it extend longitudinally in axial direction on the outer surface of a pipe or of a container and the electrodes are arranged on the resistance layer in a peripherally spaced apart relationship.

22. Heating element according to claim 3, wherein the resistance layer and the electrodes arranged on it extend longitudinally in axial direction on the inner surface of a heat roller shell and the electrodes are arranged on the resistance layer in a peripherally spaced apart relationship.

23. Heating element according to claim 22, wherein the at least two flat electrodes are arranged on the side of the resistance layer facing away from said inner surface at a distance from each other.

24. Heating element according to claim 22, wherein the electrodes essentially extend over the entire periphery and are arranged in an axially spaced apart relationship.

* * * * *